US006643968B2

(12) United States Patent
Glock

(10) Patent No.: US 6,643,968 B2
(45) Date of Patent: Nov. 11, 2003

(54) PISTOL WITH A DEVICE FOR DETERMINING THE NUMBER OF SHOTS

(76) Inventor: Gaston Glock, Klagenfurter Strasse 32a, A-9220 Velden Am Woerthersee, Oesterreich (AT)

( * ) Notice: Subject to any disclaimer, the term of this patent is extended or adjusted under 35 U.S.C. 154(b) by 0 days.

(21) Appl. No.: 10/260,507

(22) Filed: Sep. 30, 2002

(65) Prior Publication Data

US 2003/0061753 A1 Apr. 3, 2003

(30) Foreign Application Priority Data

Oct. 2, 2001 (DE) ..... 101 48 677

(51) Int. Cl.[7] ..... F41A 9/62
(52) U.S. Cl. ..... 42/1.02; 42/84
(58) Field of Search ..... 42/1.02, 1.01, 42/84

(56) References Cited

U.S. PATENT DOCUMENTS

| | | | | | |
|---|---|---|---|---|---|
| 4,433,890 | A | * | 2/1984 | Marino et al. | 439/425 |
| 4,541,191 | A | * | 9/1985 | Morris et al. | 42/1.01 |
| 5,052,138 | A | * | 10/1991 | Crain | 42/1.02 |
| 5,142,805 | A | * | 9/1992 | Horne et al. | 42/1.02 |
| 5,272,828 | A | * | 12/1993 | Petrick et al. | 42/84 |
| 5,303,495 | A | * | 4/1994 | Harthcock | 42/84 |
| 5,402,678 | A | * | 4/1995 | Fritz et al. | 73/167 |
| 5,566,486 | A | * | 10/1996 | Brinkley | 42/1.02 |
| 5,826,360 | A | * | 10/1998 | Herold et al. | 42/1.02 |
| 6,062,208 | A | * | 5/2000 | Seefeldt et al. | 124/71 |
| 6,434,875 | B1 | * | 8/2002 | Constant et al. | 42/84 |

FOREIGN PATENT DOCUMENTS

| | | |
|---|---|---|
| DE | 3911804 C2 | 10/1990 |
| DE | 40 22 038 | 1/1992 |
| DE | 4417545 A1 | 5/1994 |
| DE | 4446020 A1 | 12/1994 |
| GB | 2 182 424 | 5/1987 |
| GB | 2 351 143 | 12/2000 |
| JP | 10-089894 A | 4/1998 |

* cited by examiner

*Primary Examiner*—Michael J. Carone
*Assistant Examiner*—M. Thomson
(74) *Attorney, Agent, or Firm*—Flynn, Thiel, Boutell & Tanis, P.C.

(57) ABSTRACT

A pistol includes a carriage which receives a barrel. The carriage slides back on a handle of the pistol during discharge against the force of a return spring. The pistol includes a device for determining the number of shots fired. The device includes electronics attached to the handle and including a microprocessor with storage, a piezoelectric sensor connected to the microprocessor, a current supply, and a reading device for reading the storage, which reading device is external to the pistol. The piezoelectric sensor receives recoil impulses during discharge and sends a signal to the microprocessor in response to the impulses. The microprocessor is connected to a second sensor, which sends a second signal to the microprocessor when the carriage slides back. The microprocessor sends a count impulse to the storage during a time interval between the first signal of the piezoelectric sensor and the second signal, which corresponds to the time interval between discharge and sliding back of the carriage during a discharge.

20 Claims, 3 Drawing Sheets

PISTOL WITH A DEVICE FOR DETERMINING THE NUMBER OF SHOTS

FIELD OF THE INVENTION

The invention relates to a pistol including a device configured to determine the number of shots fired.

BACKGROUND OF THE INVENTION

Pistols supposedly capable of determining the shots fired are known (DE 39 11 804 C2 and U.S. Pat. No. 4,541,191). Since the piezoelectric sensor disclosed in these references can also be subjected to other mechanical impulses, for example, when the pistol is dropped or during firing of practice rounds due to the lock or firing-pin movement during a simulated discharge, the counting of shots fired from these pistols is flawed. In order to avoid such errors, DE 40 22 038 discloses a device having three direction and acceleration dependent sensors instead of a single sensor. DE 44 17 545 A1 discloses several sensors located in the front of the pistol muzzle configured to detect a bullet as it is flying by.

SUMMARY OF THE INVENTION

The purpose of the present invention is to provide a cost efficient pistol having a reliable device configured to determine the number of shots. This objective is achieved by the pistol disclosed herein. Further advantageous developments of the invention are also disclosed herein.

According to the present invention, the device for determining the number of shots fired by the pistol includes a piezoelectric first sensor and a second sensor. The piezoelectric sensor transmits a first signal to a microprocessor upon receipt of a mechanical impulse. The second sensor is activated when the carriage slides back during a discharge. The time interval between the first signal produced by the piezoelectric sensor and the second signal produced by the second sensor is compared by the microprocessor. The compared time interval is that between the first signal, produced as a result of the recoil impulse during a live shot, and the second signal, produced when the carriage slides back during a live shot. When the time interval is positive a count impulse is stored. When a live shot is fired, the time interval between the first and the second signals is around a few milliseconds.

A battery can be provided as the current supply. Preferably, current is supplied for storage of the data received and for operation of a real-time clock discussed below.

The remaining electronics, including the second sensor, are only supplied with current after the first sensor is activated. Thus, the first signal, produced by the piezoelectric sensor, serves at the same time as an activation signal for the electronics. The time interval for activating the microprocessor and the other connected electronics is usually a few microseconds.

If necessary, the piezoelectric sensor can be a common ceramic piezoelement. However, the piezoelectric sensor is preferably formed by a piezoelectric polymer sensor or piezofilm sensor, preferably out of fluoropolymers, in particular polyvinylidenefluoride (PVDF) and copolymers of PVDF. The piezofilm sensor consists of a piezofilm piece or a small plate, having an electric layer on each side, such as a metal layer, like silver. The electrode layers are connected to the microprocessor. Each electrode layer can have a protective outer coating.

The piezofilm sensor can be attached to any desired area of the pistol handle since the recoil impulse deforms practically the entire handle during discharge. The piezofilm sensor is advantageously arranged on a printed circuit board which also houses the electronics.

The circuit board is preferably designed as a multilayer printed circuit board. The circuit board is preferably positioned on the section of the handle between the trigger and the barrel muzzle under the carriage. The piezofilm sensor can then be arranged on the side of the circuit board opposite the carriage and can be positioned between two layers of the circuit board.

The second sensor can be designed differently than the first sensor. The second sensor can also be constructed by a piezoelectric sensor, in particular a piezofilm sensor, which is deformed by the carriage when the carriage slides back during discharge. In this instance, a nose or similar projection of the carriage will operate the piezosensor when the carriage slides back. Alternatively, if the second sensor is formed by an induction coil, a permanent magnet 27 (FIG. 1) could be positioned on the carriage.

The second sensor is preferably a coil which is supplied with current from a frequency generator. Since the carriage of the pistol consists of metal, the sensor coil is damped when a section of the carriage slides back past the coil. The oscillation amplitude reduced by damping is transmitted as a signal to the microprocessor. The section of the carriage which moves past the sensor coil can, for example, be the front face wall of the carriage. The sensor coil is preferably arranged on the side of the printed circuit board facing the carriage in order to achieve the most significant damping.

In order for the device to determine the time of firing each shot, in addition to the number of shots fired, a real-time clock is also provided on the printed circuit board. Thus, since the time of firing of a shot is recorded with each fired shot based on a reading from the real-time clock the pistol can record each firing event.

A read-out of the stored data on the pistol handle can be accomplished through a cable or contacts. Preferably the read-out does not require contacts since the pistol handle will generally consist of plastic. Thus, it is preferable to provide an RF transmitter in the pistol handle which communicates with an RF receiver as the reading device outside of the pistol. In order for the microprocessor to be programmable from outside and in order for data to be read into storage, the RF transmitter in the pistol handle is also preferably an RF receiver.

The RF transmitter and, if necessary, receiver, in the pistol handle is/are preferably arranged on the printed circuit board. The antenna for the transmitter/receiver is preferably an antenna coil and is positioned on the side of the printed circuit board opposite the carriage.

The device also includes a reading device which can be designed as a hand-held reading device. The reading device can also be configured for connection to a personal computer or laptop.

The device of the present invention can also be configured to determine further characteristic data of the pistol. The characteristic data can include data for identification of the pistol and/or data regarding the owner of the pistol, which is read into storage.

For the programming and reading-in of the characteristic data, a recording device 26 (FIG. 1) outside of the pistol can be used. The recording device can be an RF transmitter which is connected to a personal computer or laptop. The recording device can also be designed as a reading device.

The pistol identification data could include the number of the weapon, which is also applied to the weapon. The pistol identification data could also include data such as the production date of the pistol, the charge number of the pistol, etc. A recording device could be installed at the production site to input this data. The pistol ownership data read into storage could include the name of the legal owner of the weapon. The name could be read into storage via a recording device by the seller when the pistol is purchased. The data could also be read in by a public authority or similar institution. In addition, if the ownership of the pistol changes, the legal name of the new owner could be read into storage.

BRIEF DESCRIPTION OF THE DRAWINGS

The invention will be described in greater detail hereinafter by way of an example and in connection with the drawings, in which.

DETAILED DESCRIPTION

Figure 1:
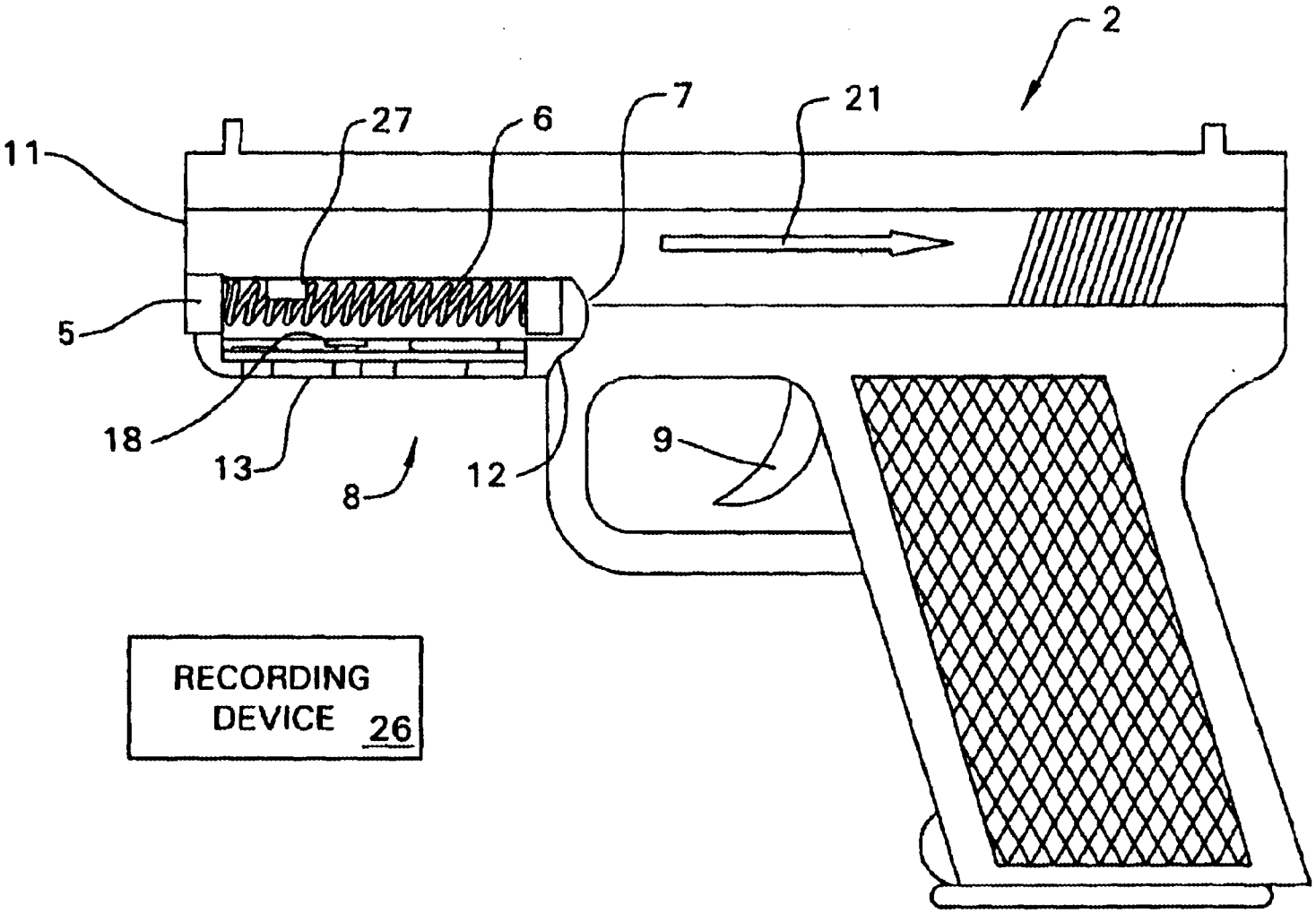
FIG. 1 is a partially sectioned side view of a pistol.
Figure 2:
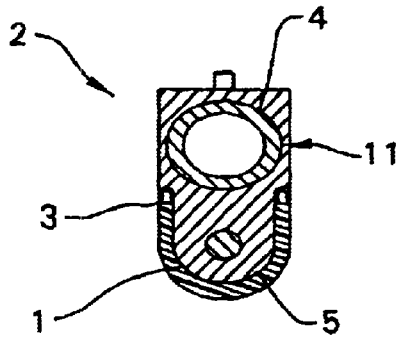
FIG. 2 is a front view of the FIG. 1 pistol.

Referring to FIG. 1, the pistol has a handle 1 and a carriage 2. The carriage 2 is movably arranged on the handle 1 by a groove/spring guide 3 (FIG. 2). The handle 1 is composed of plastic.

The pistol includes a barrel 4 which is housed in the carriage 2. The barrel 4 is stationary and fixed to the handle 1. The carriage 2 has a face wall 5, which serves as a spring plate for a return spring 6. The opposite end of the return spring is supported on the handle 1 at area 7.

Figure 3:
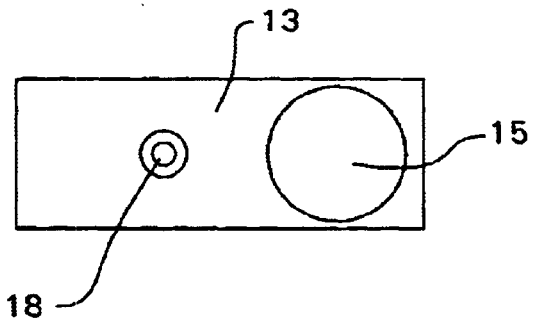
FIG. 3 is a top view of one side of the printed circuit board of the FIG. 1 pistol with the electronics, the sensors and further components.
Figure 4:
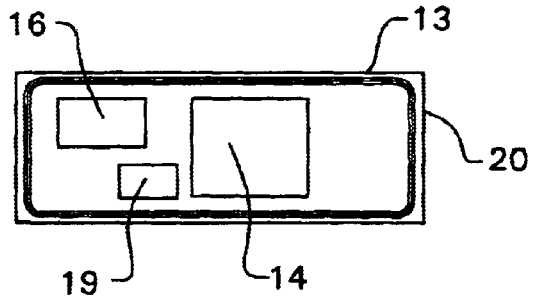
FIG. 4 is a top view of the other side of the printed circuit board of FIG. 3.

A recess 12 is provided in the section 8 of the handle 1. The recess 12 extends between a trigger 9 and a muzzle 11 of the barrel 4 under the carriage 2. The recess 12 houses a printed circuit board 13, which is illustrated in greater detail in FIGS. 3 to 5.

The printed circuit board 13 includes a microprocessor 14. The microprocessor 14 houses nonvolatile storage, for example EEPROM storage as the program storage, counter and even storage. A battery 15 is provided to supply current. The printed circuit board 13 also includes a real-time clock 16, the frequency generator 25 for driving the sensor coil one or several piezofilm sensors 17, a sensor coil 18, and an RF transmitting and receiving part 19 with an antenna coil 20. The battery 15 and the sensor coil 18 are preferably arranged on the side of the printed circuit board 13 facing the carriage 12. The antenna coil 20 is preferably arranged on the side of the printed circuit board 13 opposite the carriage 12.

The antenna coil 20 surrounds the piezofilm sensor 17. The microprocessor 14, the real-time clock 16 and the RF part 19 are arranged under the piezofilm sensor 17, which is illustrated in dashes in FIG. 4. The piezofilm sensor 17 is connected to the microprocessor 14 through the printed circuit board 13. When the piezofilm sensor 17 receives a recoil impulse during a discharge, it deforms and emits a signal to the microprocessor 14.

The sensor coil 18 is supplied with current from a frequency generator in the electronic module 14. When the carriage 2 slides back in the direction of the arrow 21 against the force of the spring 6 during a discharge, the face wall 5 moves over the sensor coil 18, causing the coil 18 to be damped. The sensor coil 18 then produces a damping signal, which is sent to the microprocessor 14, to which the sensor coil 18 is connected through the printed circuit board 13.

When the time interval between the first signal produced by the piezofilm sensor 17 during discharge and the second signal, the damped signal produced by the sensor coil 18, corresponds to a time interval for a live shot between discharge and movement of the face wall 5 past the sensor coil 18, the microprocessor 1 sends a count impulse to storage.

The battery 15 serves as the sole current supply for counting the shot fired by the pistol. In a sleep mode, the battery 15 supplies current only to the real-time clock 16 and to maintain the recorded data in storage. The other electronic components, including the microprocessor 14, the RF part 19 and the sensor coil 18, are typically in a "sleep mode", or inactive state. Thus, these components are only supplied with current when a shot is fired and the piezofilm sensor 17 sends a signal to the microprocessor 14. The signal sent by the piezofilm sensor 17 thus serves as an activation, or wake-up, signal for the electronics.

Figure 5:
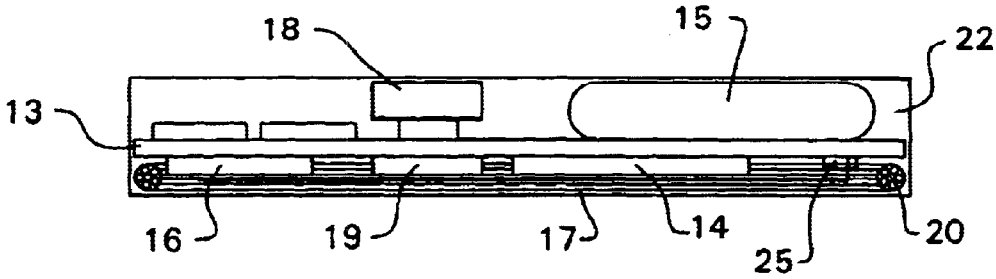
FIG. 5 is a cross-sectional view of the FIGS. 3 and 4 printed circuit boardand.

As shown in dashed lines in FIG. 5, the printed circuit board 13, including all components arranged thereon, is cast into a block 22 out of a suitable plastic material.

Figure 6:
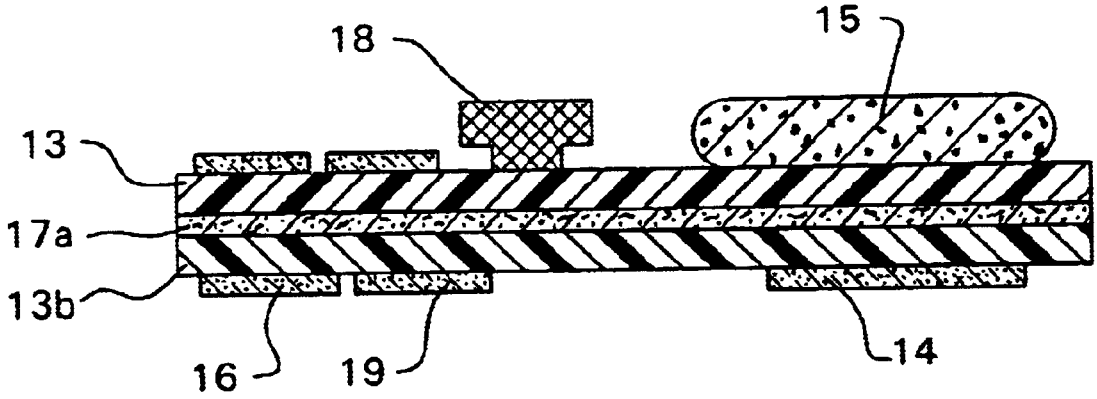
FIG. 6 is a cross sectional view of an alternative printed circuit board assembly.

FIG. 6 depicts an alternative circuit board assembly wherein the circuit board consists of multiple layers 13*a* and 13*b*. The piezoelectric sensor is a piezofilm 17*a* positioned between circuit board layers 13*a* and 13*b*.

What is claimed is:

1. A pistol, said pistol comprising:

a handle;

a barrel that is stationary and fixed relative to said handle through which a bullet is discharged;

a carriage that is slidably mounted to said handle that at least partially surrounds said barrel, wherein said carriage recoils upon discharge of the bullet;

a return spring extending between said handle and said carriage for returning said carriage to an initial position after the recoil movement of said carriage;

a piezoelectric sensor mounted to said handle to generate a first sensor signal as a result of deformation of said handle caused by a discharge-induced recoil impulse applied to said handle;

a carriage state sensor attached to said handle, said carriage state sensor configured to monitor the position of said carriage relative to said handle and to generate a second sensor signal upon said carriage engaging a select amount of recoil movement relative to said handle;

a processing circuit configured to receive the first and second sensor signals, said processing circuit including a memory in which a count of the number of bullets discharged is stored and said processing circuit is configured to:

measure the time interval between when the first sensor signal representative of the recoil-induced deformation of said handle is received and the second sensor signal representative of recoil movement of said carriage is received; and compare the measured time interval to a set time interval and, if the measured time interval correspondences to the set time interval, increasing by one the count indicating the number of bullets discharged.

2. The pistol of claim 1, wherein:

said processing circuit and said carriage state sensor are normally in a low-powered operating mode; and said processing circuit is configured to, upon receipt of the first sensor signal indicating that said handle has deformed, place said processing circuit and said carriage state sensor in a high-power operating mode.

3. The pistol of claim 1, wherein:

said carriage state sensor is a coil;

a frequency generator supplies an AC signal to said coil; and a metal member that is part of said carriage is located on said carriage to pass over said coil as a result of the recoil movement of said carriage so that the movement of said metal member effects the signal across said coil.

4. The pistol according to claim 3, wherein said metal member is part of a face wall of said carriage.

5. The pistol according to claim 1, wherein said second sensor is a piezoelectric sensor that is positioned to be displaced by said carriage during the recoil movement of said carriage.

6. The pistol according to claim 1, wherein a permanent magnet is positioned on said carriage, and said second sensor is an induction coil.

7. The pistol according to claim 1, wherein said piezoelectric sensor is a piezofilm sensor.

8. The pistol of claim 1, further including a real time clock that is integral with said processing circuit, wherein said processing circuit, when recording in said memory that a bullet has been discharged, records when the bullet was discharged based on the time from said real time clock.

9. The pistol of claim 1, further including a antenna or coil connected to said memory over which data stored in said memory are read from said memory.

10. The pistol according to claim 9, wherein said handle is composed of plastic.

11. The pistol according to claim 1, wherein said processing circuit is mounted on a printed circuit board.

12. The pistol according to claim 11, wherein at least one of said piezoelectric sensor and said second sensor are mounted on said printed circuit board.

13. The pistol according to claim 12, wherein said processing circuit and any other components mounted to said printed circuit board are embedded in plastic.

14. The pistol of claim 1, wherein:

said processing circuit is mounted to a multi-layer printed circuit board; and said piezoelectric sensor includes a piezofilm that is mounted between layers of said printed circuit board.

15. The pistol of claim 1, wherein:

a trigger is mounted to said handle and said handle has a section that extend forward of said trigger and is located under said barrel and said carriage;

a printed circuit board is disposed in the section of said trigger that extends forward of said trigger and said processing circuit is mounted to said circuit board.

16. The pistol according to claim 15, wherein:

said second sensor is a coil which is positioned on a side of said printed circuit board which faces said carriage, and an antenna is positioned on a side of said printed circuit board opposite said carriage.

17. The pistol of claim 1, wherein said memory further includes data identifying characteristics of said pistol in addition to the count of bullets that have been discharged.

18. The pistol of claim 1, wherein:

said processing circuit is electronically programmable; and a recording device separate from pistol is provided and said recording device is configured program said processing circuit and to read the data stored in said memory.

19. A pistol, said pistol comprising:

a handle;

a barrel that is stationary and fixed relative to said handle through which a bullet is discharged;

a carriage that is slidably mounted to said handle that at least partially surrounds said barrel, wherein said carriage recoils upon discharge of the bullet;

a return spring extending between said handle and said carriage for returning said carriage to an initial position after the recoil movement of said carriage;

a deformation sensor attached to said handle, said deformation sensor configured to monitor deformation of said handle and to generate a first sensor signal as a consequence of recoil-induced deformation of said handle;

a carriage state sensor attached to said handle, said carriage state sensor configured to monitor the position of said carriage relative to said handle and to generate a second sensor signal upon said carriage engaging a select amount of recoil movement relative to said handle;

a processor configured to receive the first and second sensor signals, said processor including a memory in which a count of the number of bullets discharged is stored and said processor is configured to:

measure the time interval between when the first sensor signal representative of the recoil-induced deformation of said handle is received and the second sensor signal representative of recoil movement of said carriage is received; and compare the measured time interval to a set time interval and, if the measured time interval correspondences to the set time interval, increasing by one the count indicating the number of bullets discharged.

20. The pistol of claim 19, wherein said deformation sensor is a piezoelectric sensor.

* * * * *